US009860958B2

(12) United States Patent
Li et al.

(10) Patent No.: US 9,860,958 B2
(45) **Date of Patent: *Jan. 2, 2018**

(54) DIMMING DRIVE CIRCUIT OF ALTERNATING CURRENT DIRECTLY-DRIVEN LED MODULE

(71) Applicant: SICHUAN SUNFOR LIGHT CO., LTD., Sichuan (CN)

(72) Inventors: Dongming Li, Sichuan (CN); Wentao Long, Sichuan (CN); Zhengyong Feng, Sichuan (CN); Mian Yang, Sichuan (CN)

(73) Assignee: Sichuan Sunfor Light Co., Ltd, Sichuan (CN)

( * ) Notice: Subject to any disclaimer, the term of this patent is extended or adjusted under 35 U.S.C. 154(b) by 0 days.

This patent is subject to a terminal disclaimer.

(21) Appl. No.: 14/958,744

(22) Filed: Dec. 3, 2015

(65) Prior Publication Data

US 2016/0150618 A1 May 26, 2016

Related U.S. Application Data

(63) Continuation of application No. 14/439,459, filed as application No. PCT/CN2013/085966 on Oct. 25, 2013, now Pat. No. 9,237,626.

(30) Foreign Application Priority Data

Oct. 30, 2012 (CN) ..... 2012 1 0424253

(51) Int. Cl.
*H05B 33/08* (2006.01)

(52) U.S. Cl.
CPC ..... *H05B 33/0887* (2013.01); *H05B 33/083* (2013.01); *H05B 33/0809* (2013.01);
(Continued)

(58) Field of Classification Search
CPC ..... H05B 33/0809; H05B 33/089; H05B 33/083; H05B 37/00; H05B 37/02;
(Continued)

(56) References Cited

U.S. PATENT DOCUMENTS 6,636,003 B2 * 10/2003 Rahm ..... H01L 25/0753 257/E25.02
7,081,722 B1 * 7/2006 Huynh ..... H05B 33/0818 315/185 S
(Continued)

FOREIGN PATENT DOCUMENTS

CN 101534587 A 9/2009
CN 101867168 A 10/2010
(Continued)

OTHER PUBLICATIONS

Author: www.radio-electronics.com/info/data; Title: What is a Triac-Tutorial, Publisher: Jan. 16, 2009, Pertinent pp. 1-10.*
(Continued)

*Primary Examiner* — Douglas W Owens
*Assistant Examiner* — Wei Chan
(74) *Attorney, Agent, or Firm* — Michael Ye; Andrews Kurth Kenyon LLP

(57) ABSTRACT

Disclosed is an alternating current dimming drive circuit for an LED, comprising a rectification unit and N stages of LED direct current drive circuits. In the $i^{th}$ stage of LED direct current drive circuit, a first end of the $i^{th}$ voltage sampling unit and an input end of the $i^{th}$ LED light source module directly or indirectly receive the output voltage of the rectification unit; a voltage division end of the $i^{th}$ voltage sampling unit is connected to a second input end of the $i^{th}$ switch unit; and a first input end of the $i^{th}$ switch unit is connected to an output end of the $i^{th}$ LED light source module, and an output end of the $i^{th}$ switch unit, a second
(Continued)

end of the $i^{th}$ voltage sampling unit and a second output end of the rectification unit are grounded. When the $i^{th}$ switch unit is switched on, the first to the $i^{th}$ LED light source modules emit light. When the $i^{th}$ switch unit is switched off, if i is less than N, the first to the $(i+1)^{th}$ LED light source modules emit light, and if i is equal to N, the first to the $N^{th}$ LED light source modules stop emitting light. The present invention realizes an alternating current directly-driven LED light source module and will not flicker in the case of alternating current voltage fluctuation.

8 Claims, 3 Drawing Sheets

(52) U.S. Cl.
CPC ..... *H05B 33/089* (2013.01); *H05B 33/0824* (2013.01); *H05B 33/0845* (2013.01)

(58) Field of Classification Search
CPC ..... H05B 39/00; H05B 33/0815; H05B 33/0812; H05B 33/0827; H05B 33/0845
USPC ... 315/122, 192, 185 R, 250, 294, 224, 307, 315/119, 123, 127
See application file for complete search history.

(56) References Cited

U.S. PATENT DOCUMENTS 7,800,316 B2 9/2010 Haug
8,410,720 B2 * 4/2013 Holec ..... F21V 23/005 315/209 R
8,698,407 B1 * 4/2014 Chen ..... H05B 33/0812 315/185 R
2008/0094000 A1 * 4/2008 Yamamoto ..... H05B 33/0803 315/250
2010/0060187 A1 * 3/2010 Newman, Jr. ..... H05B 33/0818 315/291
2011/0199003 A1 * 8/2011 Muguruma ..... H05B 33/083 315/122
2012/0146522 A1 * 6/2012 Jeong ..... H05B 33/083 315/192
2012/0229030 A1 * 9/2012 Moskowitz ..... H05B 33/0809 315/122
2012/0286663 A1 * 11/2012 Puvanakijjakorn ..... H05B 33/0845 315/85
2014/0159599 A1 6/2014 Tetik et al.
2014/0265899 A1 9/2014 Sadwick

FOREIGN PATENT DOCUMENTS

CN 202334293 U 7/2012
CN 102892238 A 1/2013

OTHER PUBLICATIONS

Author: Zhe Zhang, Title:Constant-current controller topology circuit powered directly by alternating current power supply for LED lighting lamp, Date:Sep. 28, 2011 (Origional).*
Author: Zhe Zhang, Title:Constant-current controller topology circuit powered directly by alternating current power supply for LED lighting lamp, Date:Sep. 28, 2011 (Translation).*
International Search Report, International Preliminary Report on Patentability and Written Opinion, International Patent Application No. PCT/CN2013/085966, dated Jan. 30, 2014.
File history of U.S. Appl. No. 14/439,459, filed Apr. 29, 2015.

* cited by examiner

DIMMING DRIVE CIRCUIT OF ALTERNATING CURRENT DIRECTLY-DRIVEN LED MODULE

This application is a Continuation of U.S. application Ser. No. 14/439,459, filed Apr. 29, 2015, which claims priority to International Patent Application No. PCT/CN2013/085966, filed Oct. 25, 2013, which claims priority to Chinese patent Application No. 201210424253.2, filed Oct. 30, 2012. The entirety of the aforementioned applications is incorporated herein by reference.

FIELD

The present disclosure generally relates to a drive circuit for an LED light source module, particularly relates to a circuit for an AC directly-driven LED light source module, and more particularly relates to a LED dimming drive circuit compatible with a silicon-controlled dimmer.

BACKGROUND

LEDs, as newly emerged solid light sources, have the prospect of becoming a new generation of light source with advantages such as energy conservation, environmental protection, long service life and the like. It is known that an LED is driven by a DC voltage. However, AC power is generally supplied in daily life. Therefore, for the LED to normally emit light, a power converter is required to implement the functions of rectification and voltage reduction. Introduction of a power converter may bring about many negative effects. Firstly, service life of the power converter is far shorter than that of the LED, so service life of a light-emitting device may be shortened. Secondly, the power converter may reduce efficiency of the light-emitting device. Thirdly, in a low-power application, the power converter may cause reduction of the power factor and increase of the total harmonic current. In order to fully utilize the advantages of the LED, an LED light-emitting device directly driven by an AC power is developed.

In conventional technical solutions of LED driving, in combination with a traditional silicon-controlled dimmer, only the traditional function of luminance adjustment is considered, but the adjustability of color temperature and hue of the LED is not taken into consideration. In addition, in most of the conventional technical solutions of LEDs driven by the AC power, multiple LED components are coupled in reverse parallel or based on a topology of a rectification bridge circuit, to meet the driving requirements of the AC power. However, the AC power is subjected to fluctuation according to a specific frequency cycle. Since the LED has its own switch-on voltage, when the transient voltage exceeds the switch-on voltage, the LED may be unintentionally switched on and emit light. Otherwise, the LED may be cut-off and does not emit light. Such circuit causes low light-emitting efficiency for the LED, and in addition, when the AC voltage fluctuates, the LED may flicker.

SUMMARY

An objective of the present disclosure is to provide a circuit for an AC directly-driven LED light source module, and in particular, a dimming drive circuit compatible with a silicon-controlled dimmer.

According to one aspect of the present disclosure, an AC dimming drive circuit for an LED is provided, including: a rectification unit and a first-stage LED DC drive circuit including a first voltage sampling unit, a first switch unit, and a first LED light source module, wherein the rectification unit receives an AC voltage, and rectifies the received AC voltage and outputs a DC voltage; the rectification unit outputs, through a first output terminal of the rectification unit, the output DC voltage to an input terminal of the first LED light source module and a first terminal of the first voltage sampling unit, an output terminal of the first LED light source module is coupled to a first input terminal of the first switch unit, a voltage division terminal of the first voltage sampling unit is coupled to a second input terminal of the first switch unit; and a second terminal of the first voltage sampling unit, an output terminal of the first switch unit, and a second output terminal of the rectification unit are grounded; the first switch unit receives, through the first LED light source module, a first switch-on voltage, and receives, through the voltage division terminal of the first voltage sampling unit, a first switch-off voltage; and when the first switch-on voltage rises to reach a first switch-on voltage threshold of the first switch unit, the first switch unit is conducted and the first LED light source module continuously emits light; and when the received first switch-off voltage rises to reach a first switch-off voltage threshold of the first switch unit, the first switch unit is switched off such that the first LED light source module stops emitting light.

The first switch-off voltage threshold is adjusted by setting an internal parameter of the first switch unit.

The AC dimming drive circuit for an LED further comprises:

an input protection unit, an input terminal of the input protection unit being coupled to the AC voltage and an output terminal of the input protection unit being coupled to an input terminal of the rectification unit.

The first LED light source module comprises:

a plurality of LED light-emitting units coupled in series;

a plurality of LED light-emitting units coupled in parallel; or a plurality of LED light-emitting units coupled partly in series and partly in parallel.

The first voltage sampling unit comprises:

a first resistor, one terminal of the first resistor being coupled to the first output terminal of the rectification unit; and a second resistor, one terminal of the second resistor being coupled to the other terminal of the first resistor and acting as the voltage division terminal of the first voltage sampling unit, and the other terminal of the second resistor being grounded.

A switch-off time of the first switch unit is adjusted by setting resistances of the first resistor and the second resistor.

The first switch unit comprises a third resistor, a fourth resistor and a fifth resistor, a first Zener diode and a second Zener diode, and a first field-effect transistor and a second field-effect transistor, wherein one terminal of the third resistor is coupled to the voltage division terminal;

a negative terminal of the first Zener diode is coupled to the voltage division terminal, and a positive terminal of the first Zener diode is grounded;

a gate of the first field-effect transistor is coupled to the other terminal of the third resistor, and a source of the first field-effect transistor is grounded;

a drain of the first field-effect transistor, one terminal of the fourth resistor, one terminal of the fifth resistor, and a negative terminal of the second Zener diode are coupled to one another;

the other terminal of the fifth resistor is coupled to a gate of the second field-effect transistor; and a drain of the second field-effect transistor, the other terminal of the fourth resistor, and a negative terminal of the first LED light source module are coupled to one another; and a positive terminal of the second Zener diode and a source of the second field-effect transistor are grounded.

Further, the AC dimming drive circuit for an LED further comprises a silicon-controlled dimmer, coupled in series between an AC live wire and the rectification unit.

Further, the AC dimming drive circuit for an LED further comprises a silicon-controlled dimmer, coupled in series between an AC live wire and the input protection unit.

According to another aspect of the present disclosure, an AC dimming drive circuit for an LED is provided, including: a rectification unit and N stages of LED DC drive circuits, an $i^{th}$ stage of LED DC drive circuit including an $i^{th}$ voltage sampling unit, an $i^{th}$ switch unit, and an $i^{th}$ LED light source module, N being a natural number greater than 1, and i=2, 3, . . . , N; wherein the rectification unit receives an AC voltage, and rectifies the received AC voltage and outputs a DC voltage;

a first terminal of the $i^{th}$ voltage sampling unit and an input terminal of the $i^{th}$ LED light source module are both coupled to a first output terminal of the rectification unit if i is equal to 1, and both coupled to an output terminal of an $i-1^{th}$ LED light source module if i is not equal to 1; a second terminal of the $i^{th}$ voltage sampling unit is grounded, and a voltage division terminal of the $i^{th}$ voltage sampling unit is coupled to a second input terminal of the $i^{th}$ switch unit;

a first input terminal of the $i^{th}$ switch unit is coupled to an output terminal of the $i^{th}$ LED light source module, and an output terminal of the $i^{th}$ switch unit and a second output terminal of the rectification unit are grounded;

the $i^{th}$ switch unit receives, through the $i^{th}$ LED light source module, an $i^{th}$ switch-on voltage, and receives, through the voltage division terminal of the $i^{th}$ voltage sampling unit, an $i^{th}$ switch-off voltage; and when the $i^{th}$ switch-on voltage rises to reach an $i^{th}$ switch-on voltage threshold of the $i^{th}$ switch unit, the $i^{th}$ switch unit is conducted and the first to the $i^{th}$ LED light source modules continuously emit light, and meanwhile an input terminal and an output terminal of the $(i+1)^{th}$ to the $N^{th}$ stage LED DC circuits are short circuited; and when the received $i^{th}$ switch-off voltage rises to reach an $i^{th}$ switch-off voltage threshold of the $i^{th}$ switch unit, the $i^{th}$ switch unit is switched off, and if i is less than N, an $(i+1)^{th}$ switch-on voltage of an $(i+1)^{th}$ switch unit is caused to rise to reach an $(i+1)^{th}$ switch-on voltage threshold, such that the first to $(i+1)^{th}$ LED light source modules emit light, and if i is equal to N, the first to $N^{th}$ LED light source modules are caused to stop emitting light.

Each LED light source module has a different or the same color temperature and hue, wherein an internal parameter of the voltage sampling unit in each stage of LED DC drive circuit is set such that a switch-off time of the switch unit in each stage of LED DC drive unit is different to control a corresponding LED light source module.

The $i^{th}$ LED light source module comprises:

a plurality of LED light-emitting units coupled in series;

a plurality of LED light-emitting units coupled in parallel; or a plurality of LED light-emitting units coupled partly in series and partly in parallel.

Further, the AC dimming drive circuit for an LED comprises an input protection unit, an input terminal of the input protection unit being coupled to the AC voltage and an output terminal of the input protection unit being coupled to an input terminal of the rectification unit.

Each voltage sampling unit comprises:

a first resistor, one terminal of the first resistor being coupled to the first output terminal of the rectification unit; and a second resistor, one terminal of the second resistor being coupled to the other terminal of the first resistor and acting as a voltage division terminal of each voltage sampling unit, and the other terminal of the second resistor being grounded.

Switch-off time of the switch unit in each stage of LED DC drive circuit is regulated by setting resistances of the first resistor and the second resistor.

Each switch unit comprises a third resistor, a fourth resistor and a fifth resistor, and a first Zener diode and a second Zener diode, and a first field-effect transistor and a second field-effect transistor, wherein one terminal of the third resistor is coupled to a voltage division terminal of the corresponding voltage sampling unit;

a negative terminal of the first Zener diode is coupled to the voltage division terminal, and a positive terminal of the first Zener diode is grounded;

a gate of the first field-effect transistor is coupled to the other terminal of the third resistor, and a source of the first field-effect transistor is grounded;

a drain of the first field-effect transistor, one terminal of the fourth resistor, one terminal of the fifth resistor, and a negative terminal of the second Zener diode are coupled to one another;

the other terminal of the fifth resistor is coupled to a gate of the second field-effect transistor; and a drain of the second field-effect transistor, the other terminal of the fourth resistor, and a negative terminal of the corresponding LED light source module are coupled to one another; and a positive terminal of the second Zener diode and a source of the second field-effect transistor are grounded.

Further, the AC dimming drive circuit for an LED further comprises a silicon-controlled dimmer, coupled in series between an AC live wire and the rectification unit.

Further, the AC dimming drive circuit for an LED further comprises a silicon-controlled dimmer, coupled in series between an AC live wire and the input protection unit.

In the present disclosure, when the transient value of the AC voltage reaches the switch-on voltages of the LED light source modules, the switch unit is conducted and the LED light source modules start emitting light; and when the transient value of the AC voltage exceeds a preset switch-off voltage, the switch unit is switched off, and the corresponding next-stage LED light source module also starts emitting light. When the silicon-controlled dimmer is tuned via a knob, the conduction angle of the silicon-controlled dimmer changes, such that the LED light source modules having different color temperatures or hues independently or collaboratively emit light, thereby implementing adjustable color temperature or hue of the entire circuit. When the AC power fluctuates, within a normal range of operating voltage, that is, between the switch-on voltage and the preset switch-off voltage of the LED light source module, only switch-on time point and switch-off time point change, and the LED light source modules still emit light. Therefore, when the AC power is subjected to fluctuation, the device does not flicker.

The present disclosure has the following advantages: the dimming drive circuit directly driving the LED module using an AC voltage is compatible with a traditional silicon-controlled dimmer, and the luminance, color temperature, or hue may be adjusted with no need of separately deploying wires; the circuit is simple in structure, small in size, light in weight, and low in cost; the input protection unit improves reliability and safety of the device, enhances electromagnetic interference resistant capabilities, and reduces electromagnetic interference caused by the power grid. The sampling resistor network controls switch-on and switch-off of the switch unit. A suitable switch-off voltage is preset, such that the AC power directly drives the LED device not to flicker in case of voltage fluctuation. Moreover, when a transient voltage of the AC power is over-high, the switch unit is switched off, and the LED light source module does not emit light, thereby improving the efficiency of the power and reducing power loss. In the meantime, this also prevents the LED light source module from being damaged due to a large current, and thus prolongs service life of the device.

DETAILED DESCRIPTION OF THE INVENTION

DETAILED DESCRIPTION

To make the objectives, technical solutions, and advantages of the present disclosure more apparent, the present disclosure is described in detail with reference to the accompanying drawings and preferred embodiments. However, it should be noted that some details set forth in the description are merely for thorough and better understanding of one or more aspects of the present disclosure, and the aspects of the present disclosure may also be implemented without such particular details.

Figure 1:
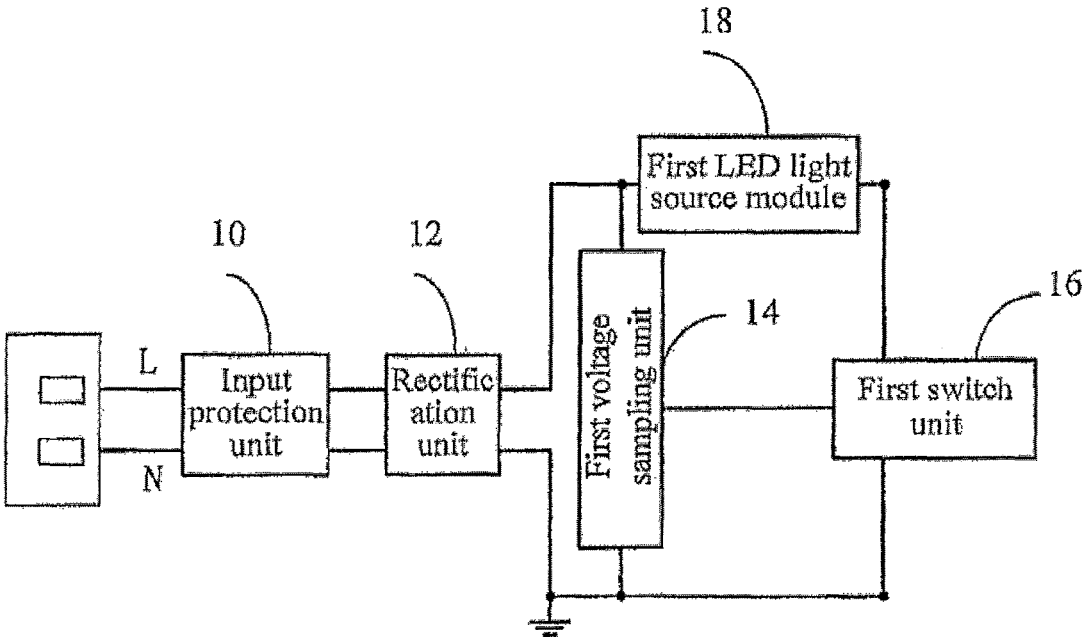
FIG. 1 is a schematic diagram of an AC dimming drive circuit for an LED according to an embodiment of the present disclosure.

FIG. 1 is a schematic diagram of an AC dimming drive circuit for an LED according to an embodiment of the present disclosure. As illustrated in FIG. 1, the AC dimming drive circuit includes a rectification unit 12, a first voltage sampling unit 14, a first switch unit 16, and a first LED light source module 18. The rectification unit 12 includes four diodes which form a rectification circuit of a bridge arrangement. Alternatively, the rectification unit 12 may also be a rectification unit of another circuit arrangement. The rectification unit 12 receives an AC voltage and rectifies the received AC voltage. The rectification unit 12 outputs, through a first output terminal, i.e. a positive terminal, of the rectification unit, a DC voltage resulted from the rectification to an input terminal of the first LED light source module 18 and a first terminal of the first voltage sampling unit 14. An output terminal of the first LED light source module 18 is coupled to a first input terminal of the first switch unit 16, and a voltage division terminal of the first voltage sampling unit 14 is coupled to a second input terminal of the first switch unit 16. A second terminal of the first voltage sampling unit 14, an output terminal of the first switch unit 16, and a second output terminal, i.e. a negative terminal, of the rectification unit 12 are grounded. The first switch unit 16 receives, through the first LED light source module 18, a first switch-on voltage, and receives, through the voltage division terminal of the first voltage sampling unit 14, a first switch-off voltage. When the first switch-on voltage rises to reach a first switch-on voltage threshold of the first switch unit 16, the first switch unit 16 is conducted and the first LED light source module 18 continuously emits light. When the received first switch-off voltage rises to reach a first switch-off voltage threshold of the first switch unit 16, the first switch unit 16 is switched off such that the first LED light source module 18 stops emitting light. In the present disclosure, the output voltage of the voltage division terminal is adjusted by setting an internal parameter of the first voltage sampling unit 14, and a switch-off time is adjusted by adjusting the first switch-off voltage threshold of the first switch unit 16.

In the present disclosure, the LED light source module comprises a plurality of LED light-emitting units coupled in series, a plurality of LED light-emitting units coupled in parallel, or a plurality of LED light-emitting units coupled partly in series and partly in parallel. The LED light source module may have different color temperatures or the same color temperature, or may have different hues or the same hue.

Optionally, as illustrated in FIG. 1, to protect the entire circuit, the AC dimming drive circuit further includes an input protection unit 10. An input terminal of the input protection unit 10 is coupled to the AC voltage and an output terminal of the input protection unit 10 is coupled to an input terminal of the rectification unit 12. It may be understood by those skilled in the art that the input protection unit is not necessary. The input protection unit 10 provides a basic protection function for the entire circuit, and constitutes of a voltage dependent resistor, a thermistor, and a fuse; and when being applied to a special environment, the input protection unit 10 may further include a common mode choke and a gas discharge tube.

Further, the AC dimming drive circuit further includes a first AC wiring terminal and a second AC wiring terminal. The AC voltage is input to the input protection unit 10 via the first AC wiring terminal and the second AC wiring terminal.

Figure 2:
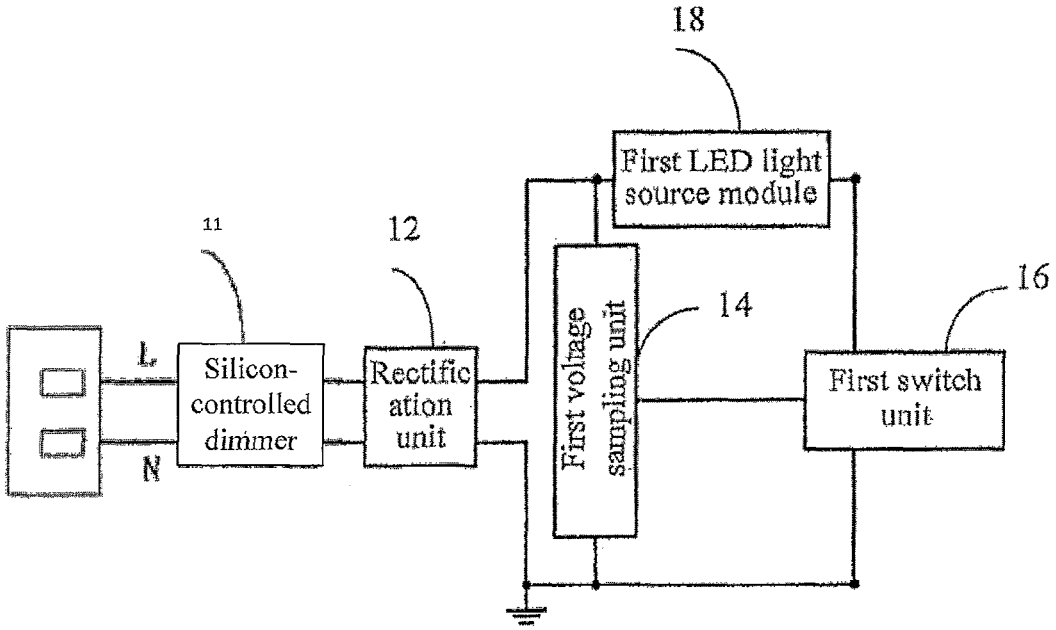
FIG. 2 is a schematic diagram of an AC dimming drive circuit for an LED according to an embodiment of the present disclosure.

FIG. 2 is a schematic diagram of an AC dimming drive circuit for an LED according to an embodiment of the present disclosure. In FIG. 2, a silicon-controlled dimmer 11 is coupled in series between the AC live wire and the rectification unit 12.

Figure 3:
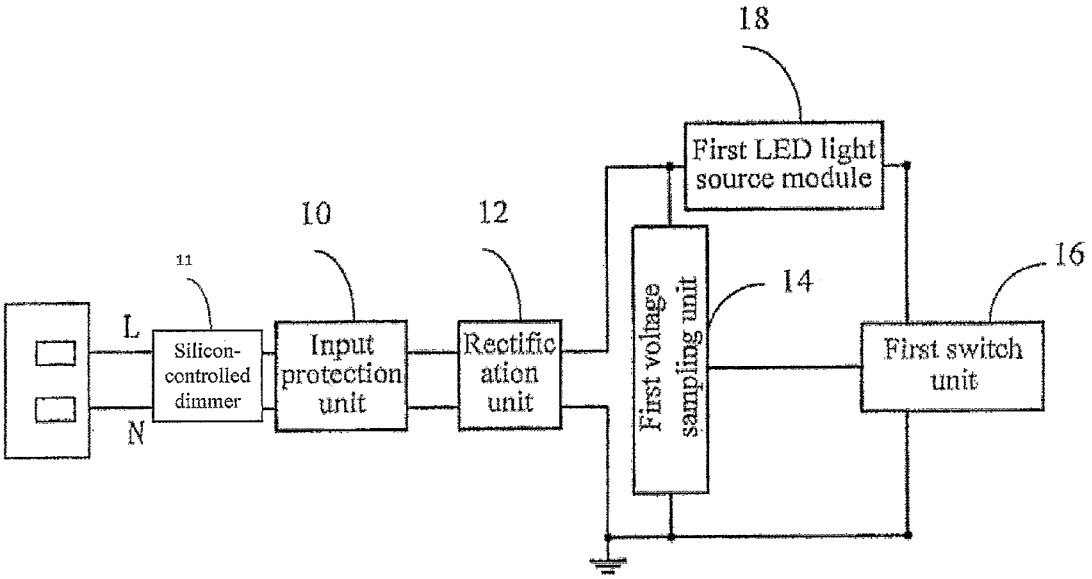
FIG. 3 is a schematic diagram of an AC dimming drive circuit for an LED according to an embodiment of the present disclosure.

FIG. 3 is a schematic diagram of an AC dimming drive circuit for an LED according to an embodiment of the present disclosure. In FIG. 3, the silicon-controlled dimmer 11 is coupled in series between the AC live wire and the input protection unit 10.

Figure 4:
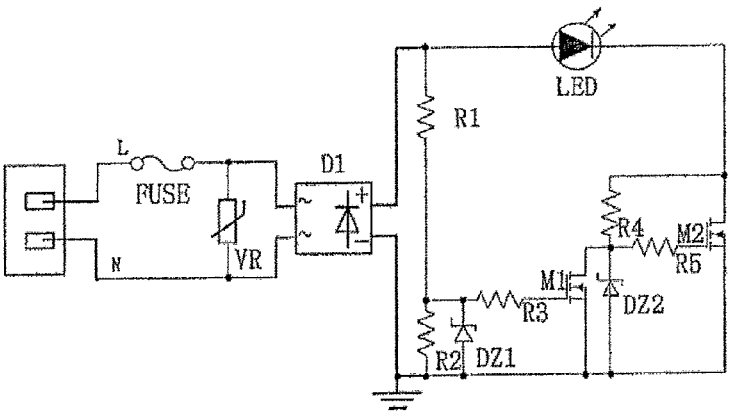
FIG. 4 is an exemplary circuit diagram of the AC dimming drive circuit for an LED as illustrated in FIG. 1.

FIG. 4 is an exemplary circuit diagram of the AC dimming drive circuit for an LED as illustrated in FIG. 1. As illustrated in FIG. 4, the input protection unit 10 constitutes of a fuse and a voltage dependent resistor VR. As described above, the AC dimming drive circuit may not include the input protection unit 10. The first voltage sampling unit 14 constitutes of a first resistor R1 and a second resistor R2. The first switch unit is formed of two field-effect transistor MOSFETs, three resistors, and two Zener diodes. The first AC wiring terminal is coupled to a terminal of the fuse and serves as an AC live wire terminal L; and the second AC wiring terminal is coupled to one terminal of the voltage dependent resistor VR and an AC input terminal of the rectification bridge of the rectification unit, and serves as an AC zero wire terminal N. The other terminal of the fuse is coupled to the other terminal of the voltage dependent resistor VR and the other AC terminal of the rectification bridge of the rectification unit 12. A positive output terminal of the rectification bridge is coupled to one terminal of the first resistor R1, and is also coupled to a positive terminal of the first LED light source module, and a negative output terminal of the rectification bridge is grounded. The other terminal of the first resistor R1 is coupled to one terminal of the second resistor R2, a negative terminal of the first Zener diode DZ1, and one terminal of the third resistor R3. The other terminal of the third resistor R3 is coupled to a gate of the first field-effect transistor M1. A drain of the first field-effect transistor M1, one terminal of the fourth resistor R4, one terminal of the fifth resistor R5, and a negative terminal of the second Zener diode DZ2 are coupled to one another. The other terminal of the fifth resistor R5 is coupled to a gate of the second field-effect transistor M2. A drain of the second field-effect transistor M2, the other terminal of the fourth resistor R4, and a negative terminal of the first LED light source module are coupled to one another. The other terminal of the second resistor R2, a positive terminal of the first Zener diode DZ1, a positive terminal of the second Zener diode DZ2, a source of the first field-effect diode M1, and a source of the second field-effect transistor M2 are grounded.

In the embodiments as illustrated in FIG. 4, the AC dimming drive circuit is coupled to the AC electric grid via a plug. The AC voltage passes through the input protection unit, and is rectified via the rectification unit to a DC voltage and then provided to the first voltage sampling unit, the first switch unit, and the first LED light source module. In each AC cycle, the voltage output from the rectification bridge rises from zero. When the voltage rises to the first switch-on voltage of the first switch unit, the first field-effect transistor M1 is switched off, the second field-effect transistor M2 is conducted, and the first LED light source module starts emitting light. As the input voltage rises, the current passing through the first LED module increases. When the voltage output from the voltage division terminal of the first sampling unit is less than a preset switch-off voltage threshold, the voltage output from the voltage division terminal of the first voltage sampling unit is not sufficient to cause the first field-effect transistor M1 to be conducted. Thus, M1 remains switched off, the second field-effect transistor M2 remains conducted, and the first LED light source module continuously emits light. When the voltage continues to rise to cause the voltage output from the voltage division terminal of the first voltage sampling unit to exceed a preset first switch-off voltage threshold, the first field-effect transistor M1 becomes conducted, the second field-effect transistor M2 is switched off, and the first LED light source module does not emit light, thereby protecting the first LED light source module from being impacted by a large current. As described above, the conduction time of the first field-effect transistor M1 may be adjusted by setting resistances of the first resistor R1 and the second resistor R2 in the first voltage sampling unit, thereby adjusting the first switch-off voltage threshold. Optionally, in the above embodiments, the switch tubes are implemented as the field-effect transistors M1 and M2. For those skilled in the art, the switch tubes in the present disclosure may be implemented as bipolar junction transistors BJTs or other switch elements having equivalent functions instead of the field-effect transistors. It may be understood by those skilled in the art that when the field-effect transistor is conducted (i.e., the first switch unit is conducted), the voltage drop between the drain and the source is very small, that is, the field-effect transistor is almost in a short-circuit state.

Figure 5:
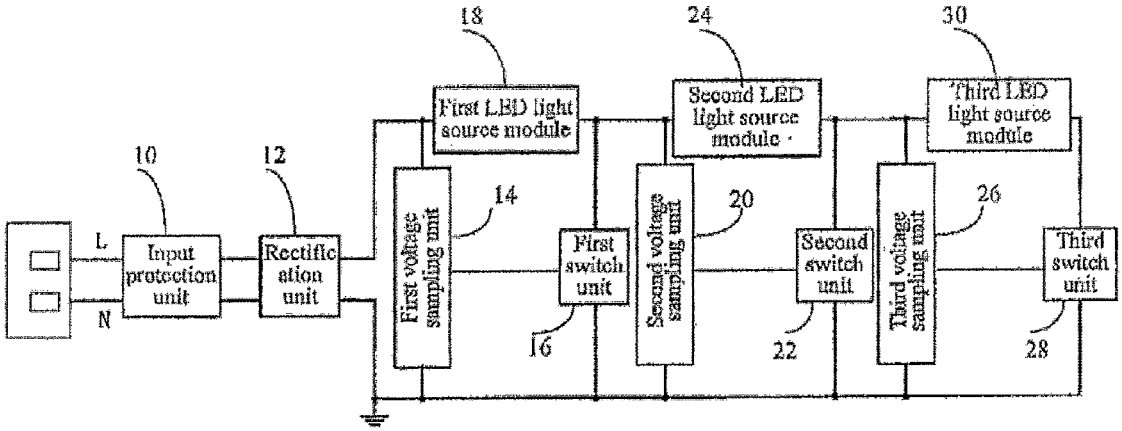
FIG. 5 is a schematic diagram of an AC dimming drive circuit for an LED according to another embodiment of the present disclosure.

FIG. 5 is a schematic diagram of an AC dimming drive circuit for an LED according to another embodiment of the present disclosure. Similar to the embodiment as illustrated in FIG. 1, the AC dimming drive circuit includes a rectification unit 12, a first voltage sampling unit 14, a first switch unit 16, and a first LED light source module 18. The first voltage sampling unit 14, the first switch unit 16, and the first LED light source module 18 form a first-stage LED DC dimming drive circuit. Further, the AC dimming drive circuit according to this embodiment further includes: a second-stage LED DC dimming drive circuit including a second voltage sampling unit 20, a second switch unit 22, and a second LED light source module 24; and a third-stage LED DC dimming drive circuit including a third voltage sampling unit 26, a third switch unit 28, and a third LED light source module 30. In this embodiment, the second voltage sampling unit 20, the second switch unit 22, and the second LED light source module 24 are respectively the same as the first voltage sampling unit 14, the first switch unit 16, and the first LED light source module 18; and similarly, the third voltage sampling unit 26, the third switch unit 28, and the third LED light source module 30 are respectively the same as the first voltage sampling unit 14, the first switch unit 16, and the first LED light source module 18.

Figure 6:
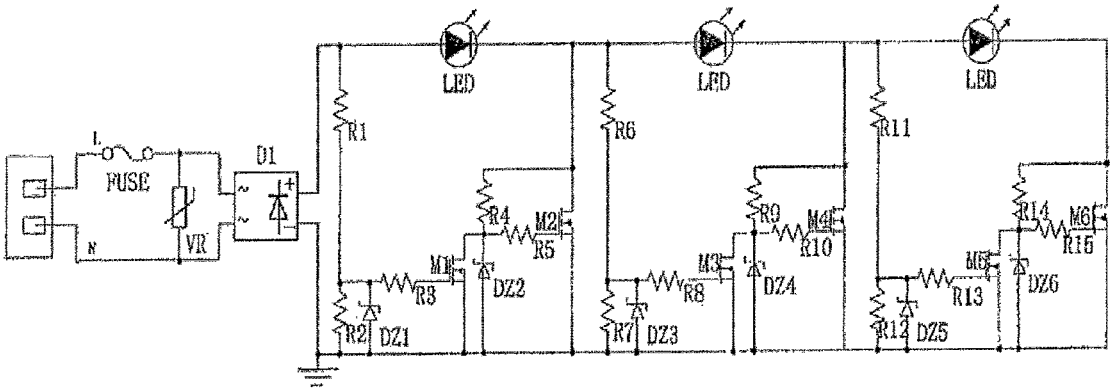
FIG. 6 is an exemplary circuit diagram of the AC dimming drive circuit for an LED according to the embodiment as illustrated in FIG. 5.

FIG. 6 is an exemplary circuit diagram of the AC dimming drive circuit for an LED according to the embodiment as illustrated in FIG. 5. As illustrated in FIG. 6, a first terminal of the second voltage sampling unit 20 and an input terminal of the second LED light source module 24 are both coupled to an output terminal of the first LED light source module 18. A second terminal of the second voltage sampling unit 20 is grounded, and a voltage division terminal of the second voltage sampling unit 20 is coupled to a second input terminal of the second switch unit 22. A first input terminal of the second switch unit 22 is coupled to an output terminal of the second LED light source module 24, and an output terminal of the second switch unit 22 is grounded. Similar to the first-stage LED DC drive circuit, the second switch unit 22 receives, through the second LED light source module 24, a second switch-on voltage, and receives, through the voltage division terminal of the second voltage sampling unit 20, a second switch-off voltage. When the first switch-on voltage reaches a first switch-on voltage threshold, the first switch unit is conducted, and the first LED light source module emits light; and meanwhile input terminals and output terminals of the second LED DC drive circuit and the third LED DC drive circuit are short circuited. Thereby, the second LED light source module does not emit light. After the first switch unit is short circuited, the second switch-on voltage gradually rises. When the second switch-on voltage rises to reach a second switch-on voltage threshold of the second switch unit 22, the second switch unit 22 is conducted and the second LED light source module 24 and the first LED light source module both continuously emit light. When the received second switch-off voltage rises to reach a second switch-off voltage threshold of the second switch unit 22, the second switch unit 22 is switched off such that the second LED light source module 24 stops emitting light.

Similar to the second-stage LED DC dimming drive circuit being coupled to the first-stage LED DC dimming drive circuit, a third-stage LED DC dimming drive circuit is coupled to the second-stage LED DC dimming drive circuit. Specifically, a first terminal of the third voltage sampling unit 26 and an input terminal of the third LED light source module 28 are both coupled to an output terminal of the second LED light source module 24. A second terminal of the third voltage sampling unit 26 is grounded, and a voltage division terminal of the third voltage sampling unit 26 is coupled to a second input terminal of the third switch unit 30. A first input terminal of the third switch unit 30 is coupled to an output terminal of the third LED light source module 28, and an output terminal of the third switch unit 30 is grounded. Similar to the first-stage LED DC drive circuit, the third switch unit 30 receives, through the third LED light source module 28, a third switch-on voltage, and receives, through the voltage division terminal of the third voltage sampling unit 26, a third switch-off voltage. When either the first switch unit or the second switch unit is conducted, the third-stage LED DC drive circuit is short circuited, and thereby, the third LED light source module does not emit light. When the first switch unit and the second switch unit are both switched off, the third switch-on voltage gradually rises. When the third switch-on voltage rises to reach a third switch-on voltage threshold of the third switch unit 30, the third switch unit 30 is conducted and the first to third LED light source modules 28 continuously emit light. When the received third switch-off voltage rises to reach a third switch-off voltage threshold of the third switch unit 30, the third switch unit 30 is switched off such that all the LED light source modules 28 stop emitting light, thereby achieving the objective of protecting the LED module units.

In the second-stage LED DC drive circuit, the second voltage sampling unit is formed of two resistors, and the second switch unit is formed of two MOSFETs, three resistors, and two Zener diodes. Similarly, in the third-stage LED DC drive circuit, the third voltage sampling unit is formed of two resistors, and the third switch unit is formed of two MOSFETs, three resistors, and two Zener diodes. The specific configuration of the circuit of the second-stage LED DC drive circuit is similar to that of the third-stage LED DC drive circuit, which is not repeated herein.

In this embodiment, the AC dimming drive circuit may adjust the brightness, color temperature, or hue of the first to third LED light source modules. Specifically, internal parameters of each of the first to third voltage sampling units, for example, resistances of two voltage division resistors in each voltage sampling unit are set, such that each stage of switch unit may have a different switch-off time. In this way, a conduction time of the LED light source module for a specific color temperature or hue is controlled, and thus changes of the color temperature or hue of the entire lighting device are adjusted.

Optionally, the AC dimming drive circuit may further include an input protection unit 10 to protect the entire circuit.

In the above embodiment, the AC dimming drive circuit for an LED includes one stage of LED DC dimming drive circuit or three stages of LED DC dimming drive circuits. Based on the principles of the above embodiments, it may be understood by those skilled in the art that the present disclosure may be applicable to two stages or more than three stages of LED DC dimming drive circuits.

In N stages of LED DC dimming drive circuits (N is a natural number greater than 1), the configuration of the circuit of the first-stage LED DC dimming drive circuit is described as the above, and in addition, an $i^{th}$ stage is coupled to an $i-1^{th}$ stage of LED DC dimming drive circuit in a same manner the second stage is coupled to the first stage of LED DC dimming drive circuit, where, i is an integer, and i=2, 3, 4, . . . , N. The $i^{th}$-stage LED DC drive circuit includes an $i^{th}$ voltage sampling unit, an $i^{th}$ LED light source module, and an $i^{th}$ switch unit. The specific configuration of the $i^{th}$ LED DC drive circuit is the same as the configuration of the first LED DC dimming drive circuit as described in the above embodiment. The $i^{th}$ switch unit receives, through the $i^{th}$ LED light source module, an $i^{th}$ switch-on voltage, and receives, through the voltage division terminal of the $i^{th}$ voltage sampling unit, an $i^{th}$ switch-off voltage. When the $i^{th}$ switch-on voltage rises to reach an $i^{th}$ switch-on voltage threshold of the $i^{th}$ switch unit, the $i^{th}$ switch unit is conducted and all of the first i LED light source modules continuously emit light. Then, after the $i^{th}$ switch unit is conducted, an input terminal and an output terminal of the next stage, i.e. of the $(i+1)^{th}$-stage LED DC drive circuit, are short circuited. Thereby, the $(i+1)^{th}$ LED light source module does not emit light. When the received $i^{th}$ switch-off voltage rises to an $i^{th}$ switch-off voltage threshold of the $i^{th}$ switch unit, the $i^{th}$ switch unit is switched off. If i<N, after the $i^{th}$ switch unit is switched off, an $(i+1)^{th}$ switch-on voltage of the $(i+1)^{th}$ switch unit in the $(i+1)^{th}$-stage LED DC drive circuit gradually rises to reach an $(i+1)^{th}$ switch-on voltage threshold. Then, the $(i+1)^{th}$ switch unit is conducted, and all of the first i+1 LED light source modules emit light. Otherwise, if i=N, after the $i^{th}$ switch unit is switched off, all of the LED light source modules stop emitting light.

Similarly, an internal parameter of the $i^{th}$ voltage sampling unit, for example, resistances of two voltage division resistors in each voltage sampling unit, are set such that each stage of switch unit has a different switch-off time. In this way, a conduction time of the LED light source module for a specific color temperature or hue is controlled, and thus changes of the color temperature or hue of the $i^{th}$ LED light source module in the entire lighting device are adjusted.

Accordingly, in the above embodiments of the present disclosure, the voltage sampling unit is capable of monitoring an input voltage, and also achieves the function of protecting the LED light source module. When the AC voltage is subjected to a great fluctuation, the switch unit in each stage may be timely switched off, thereby protecting the LED light source module in this stage from being damaged due to a large current.

In addition, the AC dimming drive circuit for an LED according to the present disclosure may further include a silicon-controlled dimmer (not illustrated in the drawings). Under such circumstances, the input terminal of the input protection unit may be coupled to an AC voltage via the silicon-controlled dimmer. The silicon-controlled dimmer may cut the phase of the input AC voltage. Therefore, the voltage input to the rectification unit does not have a complete sinusoidal waveform. A voltage switch-off point is set for each stage of switch unit in the voltage sampling unit in each stage of LED DC drive circuit, such that light source modules having different color temperatures or hues independently or collaboratively emit light, thereby adjusting the color temperature or hue of the LED light source module. In the present disclosure, the silicon-controlled dimmer may be directly coupled in series to a loop of the entire circuit, and the luminance, color temperature, or hue may be adjusted with no need of separately deploying a control loop.

In the present disclosure, the dimming drive circuit directly driving the LED module using an AC voltage is compatible with a traditional silicon-controlled dimmer, and the luminance, color temperature, or hue may be adjusted with no need of separately deploying wires. The circuit according to the present disclosure is simple in structure, small in size, light in weight, and low in cost. Use of the input protection unit improves reliability and safety of the device, enhances electromagnetic interference resistant capabilities, and reduces electromagnetic interference caused by the electric grid. A suitable switch-off voltage is set for the voltage sampling resistor network controlling conduction or switch-off of the switch unit, and therefore the LED light source module is directly driven by the AC voltage. In addition, the LED light source module does not flicker when the AC voltage is subjected to fluctuation. Moreover, when a transient voltage of the AC power is over-high, the switch unit is switched off, and the LED light source module does not emit light, thereby improving efficiency of the power and reducing power loss. In the mean time, this also prevents the LED light source module from being damaged due to a large current, and thus prolongs service life of the device.

Described above are preferred embodiments of the present disclosure. It should be noted that those skilled in the art may derive other alterations or modifications without departing from the principles of the present disclosure. Such alterations and modifications shall be deemed as falling within the protection scope of the present disclosure.

What is claimed is:

1. An AC dimming drive circuit for an LED, characterized by comprising: a rectification unit and N stages of LED DC drive circuits, an $i^{th}$ stage of LED DC drive circuit comprising an $i^{th}$ voltage sampling unit, an $i^{th}$ switch unit, and an $i^{th}$ LED light source module, N being a natural number greater than 1, and i=2, 3, . . . , N; wherein the rectification unit receives an AC voltage, and rectifies the received AC voltage and outputs a DC voltage;

a first terminal of the $i^{th}$ voltage sampling unit and an input terminal of the $i^{th}$ LED light source module are both directly coupled to an output terminal of an $i-1^{th}$ LED light source module; a second terminal of the $i^{th}$ voltage sampling unit is grounded, and a voltage division terminal of the $i^{th}$ voltage sampling unit is coupled to a second input terminal of the $i^{th}$ switch unit;

a first input terminal of the $i^{th}$ switch unit is coupled to an output terminal of the $i^{th}$ LED light source module, and an output terminal of the $i^{th}$ switch unit and a second output terminal of the rectification unit are grounded;

the $i^{th}$ switch unit receives, through the $i^{th}$ LED light source module, an $i^{th}$ switch-on voltage, and receives, through the voltage division terminal of the $i^{th}$ voltage sampling unit, an $i^{th}$ switch-off voltage; and when the $i^{th}$ switch-on voltage rises to reach an $i^{th}$ switch-on voltage threshold of the $i^{th}$ switch unit, the $i^{th}$ switch unit is conducted and the first to the $i^{th}$ LED light source modules continuously emit light, and meanwhile an input terminal and an output terminal of each of the $(i+1)^{th}$ to the $N^{th}$ stage LED DC circuits are short circuited; and when the received $i^{th}$ switch-off voltage rises to reach an $i^{th}$ switch-off voltage threshold of the $i^{th}$ switch unit, the $i^{th}$ switch unit is switched off, and if i is less than N, an $(i+1)^{th}$ switch-on voltage of an $(i+1)^{th}$ switch unit is caused to rise to reach an $(i+1)^{th}$ switch-on voltage threshold, such that the first to $(i+1)^{th}$ LED light source modules emit light, and if i is equal to N, after the $i^{th}$ switch unit is switched off, causing the first to $N^{th}$ LED light source modules to stop emitting light.

2. The AC dimming drive circuit for an LED according to claim 1, wherein each LED light source module has a different or the same color temperature and hue; wherein an internal parameter of the voltage sampling unit in each stage of LED DC drive circuit is set such that a switch-off time of the switch unit in each stage of LED DC drive unit is different to control a corresponding LED light source module.

3. The AC dimming drive circuit for an LED according to claim 1, wherein the $i^{th}$ LED light source module comprises:

a plurality of LED light-emitting units coupled in series;

a plurality of LED light-emitting units coupled in parallel; or a plurality of LED light-emitting units coupled partly in series and partly in parallel.

4. The AC dimming drive circuit for an LED according to claim 1, further comprising:

an input protection unit, an input terminal of the input protection unit being coupled to the AC voltage and an output terminal of the input protection unit being coupled to an input terminal of the rectification unit.

5. The AC dimming drive circuit for an LED according to claim 1, wherein each voltage sampling unit comprises:

a first resistor, one terminal of the first resistor being coupled to the first output terminal of the rectification unit; and a second resistor, one terminal of the second resistor being coupled to the other terminal of the first resistor and acting as a voltage division terminal of each voltage sampling unit, and the other terminal of the second resistor being grounded.

6. The AC dimming drive circuit for an LED according to claim 5, wherein a switch-off time of the switch unit in each stage of LED DC drive circuit is adjusted by setting resistances of the first resistor and the second resistor.

7. The AC dimming drive circuit for an LED according to claim 1, further comprising:

a silicon-controlled dimmer, coupled in series between an AC live wire and the rectification unit.

8. The AC dimming drive circuit for an LED according to claim 4, further comprising:

a silicon-controlled dimmer, coupled in series between an AC live wire and the input protection unit.

* * * * *